US011746652B2

(12) United States Patent
Widener

(10) Patent No.: US 11,746,652 B2
(45) Date of Patent: Sep. 5, 2023

(54) TOOL BIT ASSEMBLY

(71) Applicant: XCal Tools—Bristol, LLC, Pittsburgh, PA (US)

(72) Inventor: Brian Keith Widener, Blountville, TN (US)

(73) Assignee: XCal Tools—Bristol, LLC, Pittsburgh, PA (US)

( * ) Notice: Subject to any disclaimer, the term of this patent is extended or adjusted under 35 U.S.C. 154(b) by 0 days.

(21) Appl. No.: 17/714,661

(22) Filed: Apr. 6, 2022

(65) Prior Publication Data

US 2022/0325624 A1 Oct. 13, 2022

Related U.S. Application Data

(60) Provisional application No. 63/171,886, filed on Apr. 7, 2021.

(51) Int. Cl.
*E21C 35/197* (2006.01)
*E21C 35/18* (2006.01)

(52) U.S. Cl.
CPC ..... *E21C 35/197* (2013.01); *E21C 35/188* (2020.05)

(58) Field of Classification Search
CPC ..... E21C 35/197; B28D 1/186; E02F 9/2808
See application file for complete search history.

(56) References Cited

U.S. PATENT DOCUMENTS 4,247,150 A * 1/1981 Wrulich ..... E21C 35/197 175/227
6,113,195 A 9/2000 Mercier et al.
9,234,424 B1 1/2016 Lehnert et al.
2010/0295360 A1* 11/2010 Kramer ..... E21C 35/197 299/110

FOREIGN PATENT DOCUMENTS

DE 202004012139 U1 * 11/2004 ..... E21C 35/197

* cited by examiner

*Primary Examiner* — Janine M Kreck
(74) *Attorney, Agent, or Firm* — The Webb Law Firm

(57) ABSTRACT

A tool bit assembly includes a shank having an elongated shaft, an intermediate portion extending from the shaft, a head extending from the intermediate portion, and a tool portion extending from the head. The assembly includes a retainer with a body defining a hollow shaft configured to receive at least a portion of the elongated shaft of the shank therethrough, and a washer defining an opening extending from a first end to a second end of the washer, and the washer having at least a first step and a second step. The opening of the washer is configured to receive at least a portion of the intermediate portion of the shank therethrough. The first step is configured to abut a bottom surface of the head of the shank, and the second step is configured to abut a first shoulder of the intermediate portion of the shank.

17 Claims, 9 Drawing Sheets

TOOL BIT ASSEMBLY

CROSS-REFERENCE TO RELATED APPLICATIONS

This application claims priority to U.S. Provisional Patent Application Ser. No. 63/171,886, titled Tool Bit Assembly and filed on Apr. 7, 2021, the disclosure of which is incorporated by reference in its entirety.

BACKGROUND OF THE INVENTION

Field of the Invention

The present invention relates to a tool bit assembly and, specifically, to a washer for a tool bit assembly.

Description of Related Art

Mining, trenching, and construction tools often include a hardened steel body having a hardened tip and retaining sleeve. The tools can be mounted in various formations and orientations with tools being replaceable within a tool holder. During use, the tools wear down, which causes the material being cut by the tool to start to wear on the base sleeve or block of the tool holder, decreasing the life of those components. To prolong the life of various tools, a free rotation of the tool when in service is desired. However, some operations create fines between mating surfaces that inhibit rotation. Therefore, it is desirable to use a washer with the tool that prohibits or reduces the amount of these fines.

SUMMARY OF THE INVENTION

A tool bit assembly may include a shank having an elongated shaft, an intermediate portion extending from the shaft, a head extending from the intermediate portion, and a tool portion extending from the head; a retainer including a first end and a second end with a body defining a hollow shaft therebetween, the hollow shaft configured to receive at least a portion of the elongated shaft of the shank therethrough; and a washer having a first end and a second end, the washer defining an opening extending from the first end to the second end of the washer, and the washer comprising at least a first step and a second step, the opening of the washer configured to receive at least a portion of the intermediate portion of the shank therethrough. The first step may be configured to abut a bottom surface of the head of the shank, and the second step may be configured to abut a first shoulder of the intermediate portion of the shank.

The tool portion of the shank may include a carbide tip. The opening of the washer may define defines a first passage extending from the first end to the second step and a second passage extending from the second step to the second end. The first passage and the second passage may be configured to receive at least a portion of the intermediate portion therein. The second end may abut the first end of the retainer. A top surface of the head of the shank may have a first diameter, and the bottom surface of the head of the shank may have a second diameter larger than the first diameter. The intermediate portion may include a first engagement surface comprising the first shoulder, the first engagement surface having a third diameter smaller than the second diameter.

The first passage may receive at least a portion of the first engagement surface therein. The retainer may further include a plurality of indentations proximate the second end. The retainer may further include a gap along the entire length thereof. The top surface of the head of the shank may include a nipple extending in an axial direction, and the nipple may be configured to engage with the machining tool. The tool portion may include a receiving slot configured to receive the nipple therein. A transition between the first step of the washer and the first passage may include a first radiused portion. A transition between the second step of the washer and the second passage may include a second radiused portion. A transition between the first passage and the second step of the washer may include a third radiused portion. The first radiused portion may be smaller than the second radiused portion. A top surface of the washer may include a frustoconical surface positioned radially outward from the first step. The second end of the washer may further include a centering portion having a frustoconical outer surface. The first step and the second step of the washer may each be planar.

In some embodiments or aspects, the present disclosure may be characterized by one or more of the following numbered clauses:

Clause 1: A tool bit assembly comprising: a shank comprising an elongated shaft, an intermediate portion extending from the elongated shaft, a head extending from the intermediate portion, and a tool portion extending from the head; a retainer comprising a first end and a second end with a body defining a hollow shaft therebetween, the hollow shaft configured to receive at least a portion of the elongated shaft of the shank therethrough; and a washer having a first end and a second end, the washer defining an opening extending from the first end to the second end of the washer, the washer comprising at least a first step and a second step, the opening of the washer configured to receive at least a portion of the intermediate portion of the shank therethrough, wherein the first step is configured to abut a bottom surface of the head of the shank, and the second step is configured to abut a first shoulder of the intermediate portion of the shank.

Clause 2: The tool bit assembly of clause 1, wherein the tool portion of the shank comprises a carbide tip.

Clause 3: The tool bit assembly of clause 1 or 2, wherein the opening of the washer defines a first passage extending from the first end to the second step and a second passage extending from the second step to the second end, and wherein the first passage and the second passage are configured to receive at least a portion of the intermediate portion therein, and wherein the second end abuts the first end of the retainer.

Clause 4: The tool bit assembly of any of clauses 1-3, wherein a top surface of the head of the shank has a first diameter and the bottom surface of the head of the shank has a second diameter larger than the first diameter.

Clause 5: The tool bit assembly of any of clauses 1-4, wherein the intermediate portion comprises a first engagement surface comprising the first shoulder, the first engagement surface having a third diameter smaller than the second diameter.

Clause 6: The tool bit assembly of any of clauses 1-5, wherein the first passage receives at least a portion of the first engagement surface therein.

Clause 7: The tool bit assembly of any of clauses 1-6, wherein the retainer further comprises a plurality of indentations proximate the second end.

Clause 8: The tool bit assembly of any of clauses 1-7, wherein the retainer further comprises a gap along an entire length thereof.

Clause 9: The tool bit assembly of any of clauses 1-8, wherein the top surface of the head of the shank comprises a nipple extending in an axial direction, and wherein the nipple is configured to engage with the machining tool.

Clause 10: The tool bit assembly of any of clauses 1-9, wherein the tool portion comprises a receiving slot configured to receive the nipple therein.

Clause 11: The tool bit assembly of any of clauses 1-10, wherein a transition between the first step of the washer and the first passage comprises a first radiused portion.

Clause 12: The tool bit assembly of any of clauses 1-11, wherein a transition between the second step of the washer and the second passage comprises a second radiused portion.

Clause 13: The tool bit assembly of any of clauses 1-12, wherein a transition between the first passage and the second step of the washer comprises a third radiused portion.

Clause 14: The tool bit assembly of any of clauses 1-13, wherein the first radiused portion is smaller than the second radiused portion.

Clause 15: The tool bit assembly of any of clauses 1-14, wherein a top surface of the washer comprises a frustoconical surface positioned radially outward from the first step.

Clause 16: The tool bit assembly of any of clauses 1-15, wherein the second end of the washer further comprises a centering portion having a frustoconical outer surface.

Clause 17: The tool bit assembly of any of clauses 1-16, wherein the first step and the second step of the washer are each planar.

DESCRIPTION OF THE INVENTION

Figure 2:
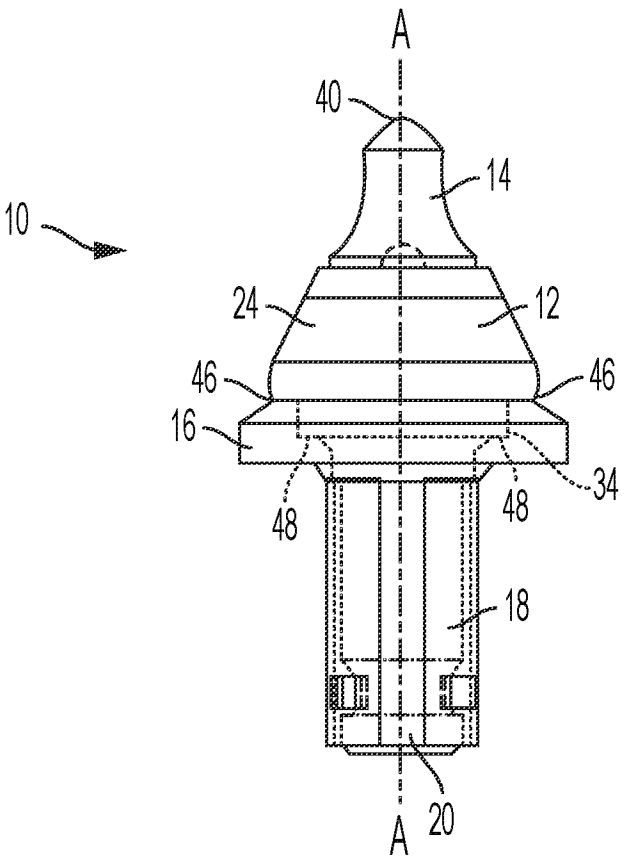
FIG. 2 is a side view of the tool bit assembly of FIG. 1, showing internal features via hidden lines.

As used herein, the singular form of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

The terms "first", "second", and the like are not intended to refer to any particular order or chronology, but refer to different conditions, properties, or elements.

The term "at least" is synonymous with "greater than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

Figure 1:
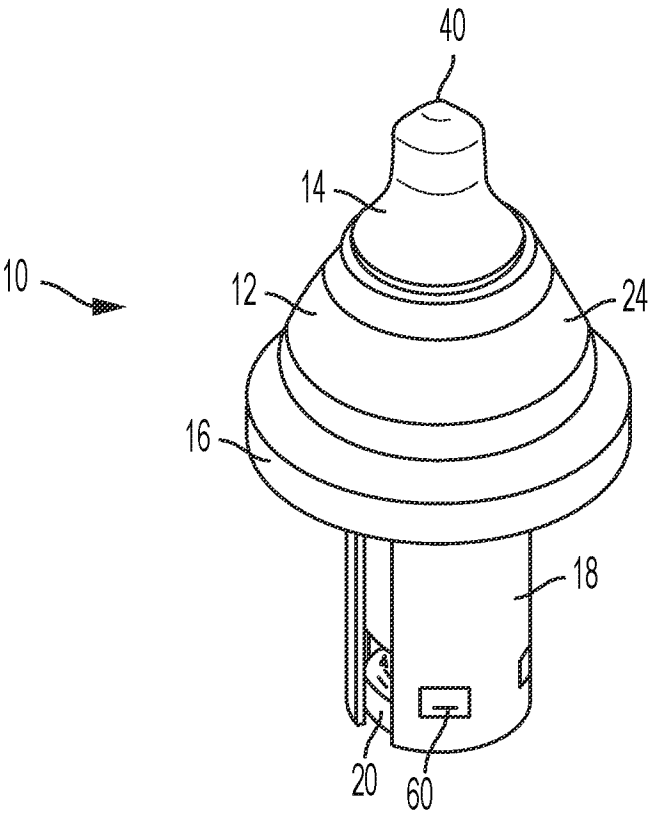
FIG. 1 is a perspective view of a tool bit assembly.

Referring to FIGS. 1 and 2, according to one non-limiting aspect or embodiment, the present application is directed to a tool bit assembly 10 for use in mining and construction. The assembly 10 includes a shank 12, a tool portion 14, a washer 16, and a retaining sleeve 18. The assembly 10 is configured to fit in a tool holder (not shown). When in the tool holder, a machining device can drive, rotate, or otherwise operate the assembly 10 so that the tool portion 14 can cut an application surface. As shown, the tip 40 of the tool portion 14 is used to cut or operate on an application surface, but those having skill in the art will understand that different tips applied to different tools can be used in order achieve a desired result with respect to the application surface.

Figure 4:
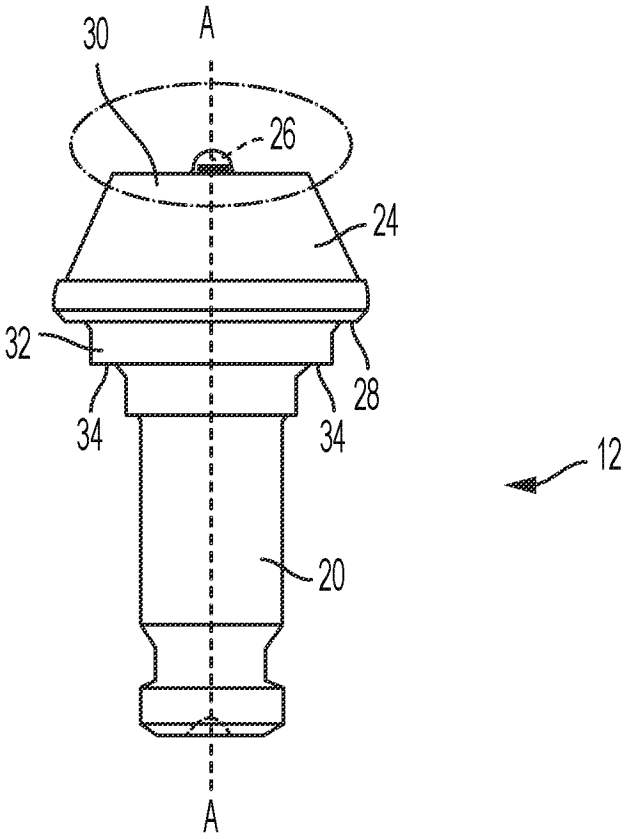
FIG. 4 is a side view of the shank of FIG. 3.
Figure 3:
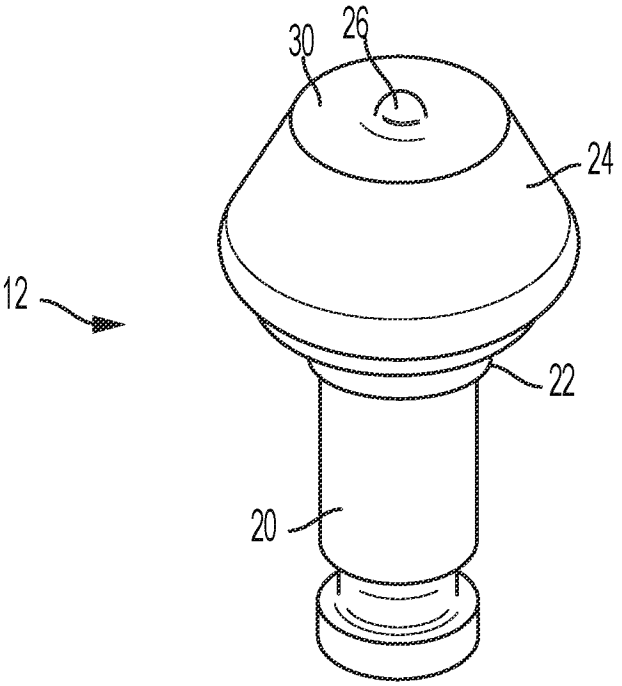
FIG. 3 is a perspective view of a shank of the tool bit assembly of FIG. 1.
Figure 5:
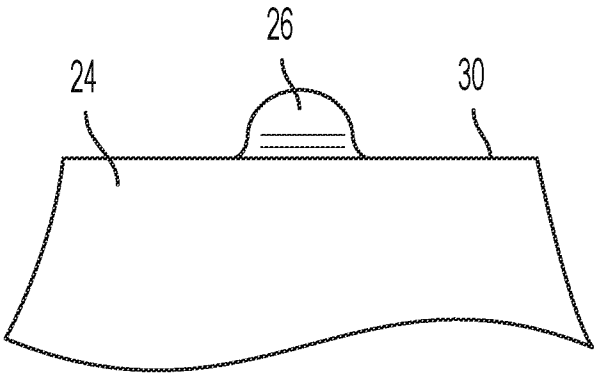
FIG. 5 is a partial side view of the top of the shank circled in FIG. 4.

With reference to FIGS. 3-5, the shank 12 includes an axis A, about which all elements of the shank 12 rotate during use of the assembly 10. A shaft 20 extends along the axis A and is partially encased by the retaining sleeve 18, as will be described below. An intermediate portion 22 extends from the shaft 20 in the axial direction. The intermediate portion 22 includes an engaging portion or surface 32 that extends radially beyond the shaft 20. The engaging portion 32 is received by the washer 16, as will be described below. As shown, the engaging portion 32 is stepped, defining one more shoulders 34 that abut portions of the washer 16. The engaging portion 32 is also cylindrical, with the step or shoulder 34 forming a planar surface extending perpendicular to the axis A between each step or shoulder 34. The steps or shoulders 34 include a radiused transition between each step or shoulder 34 and between the step or shoulder 34 and the shaft 20. Although two shoulders 34 are shown engaging the washer 16 in FIG. 2, it is contemplated that any number of steps or shoulders 34 may be provided at the intermediate portion 22 depending on the desired length and application of the assembly 10. In the instance that multiple shoulders 34 are provided at the intermediate portion 22, it is understood that the internal shape of the washer 16 will be modified to accommodate the additional shoulders.

A head 24 extends from the intermediate portion 22 in the axial direction. As shown, the head 24 is frustoconically shaped, having an outer surface that tapers in the direction of a nipple 26, which extends away from the intermediate portion 22 and the shaft 20. Other shapes of the head 24 may be used by those having skill in the art depending on the particular uses of the assembly 10 and the tool portion 14 to be applied. A bottom surface 28 of the head 24 extends radially beyond the intermediate portion 22 and has a larger diameter than that of the engaging portion 32 of the intermediate portion 22. The taper of the frustoconical head 24 provides a top surface 30 having a smaller diameter than the bottom surface 28. As shown, the top surface 30 has a smaller diameter than the engaging portion 32. However, the top surface 30 may have a larger diameter than the engaging portion 32 depending on how the assembly 10 and tool portion 14 will be used. The diameter of the top surface 30 relative to any other element of the intermediate portion 22 may also change depending on the desired use of the assembly 10.

The nipple 26 extends from the top surface 30 and is used to engage with the tool portion 14 of the assembly 10 in order to connect the tool portion 14 to the shank 12. The nipple 26 also shares axis A with the shank 12. The nipple 26 fits into a receiving hole 38, shown in FIGS. 6 and 8, that extends into a bottom surface 36 of the tool portion 14. By way of the nipple 26, the tool portion 14 can rotate via spinning of the shank 12 of the shaft 20 which occurs by attaching the assembly 10 to the necessary tool holder and machinery as described above.

Figure 6:
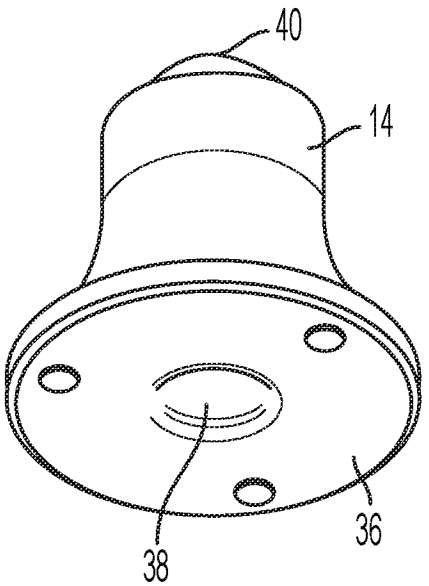
FIG. 6 is a bottom perspective view of a carbide tip of the tool bit assembly of FIG. 1.
Figure 8:
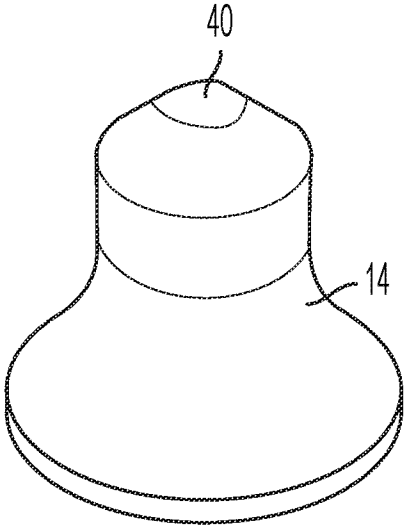
FIG. 8 is a top perspective view of the carbide tip of FIG. 1.
Figure 7:
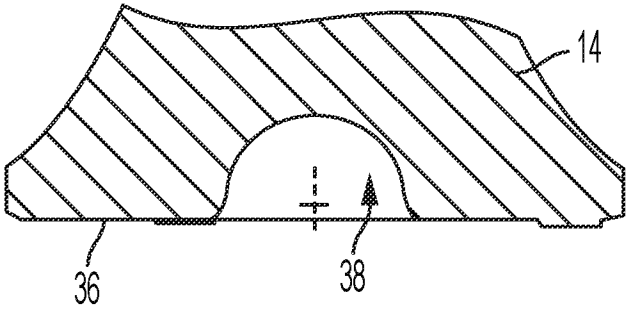
FIG. 7 is a partial cross-sectional view of the bottom of the carbide tip of FIG. 6.
Figure 10:
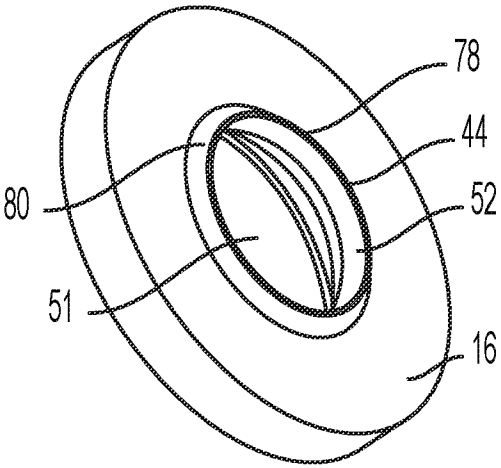
FIG. 10 is a bottom perspective view of the washer of FIG. 1.
Figure 9:
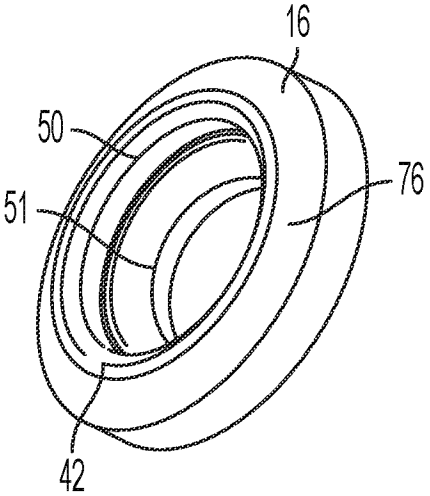
FIG. 9 is a top perspective view of a washer of the tool bit assembly of FIG. 1.
Figure 12:
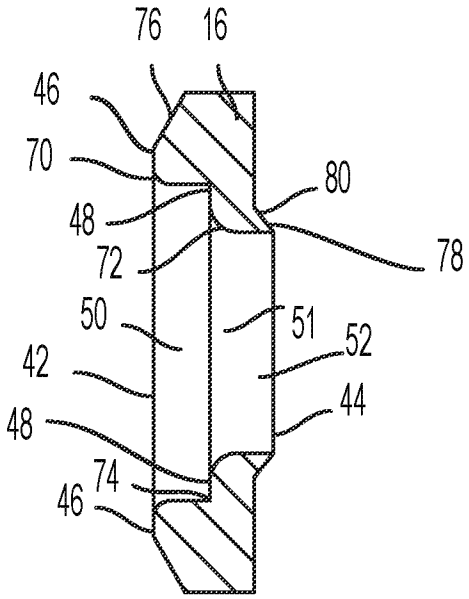
FIG. 12 is a cross-sectional view taken along line 12-12 in FIG. 11.
Figure 11:
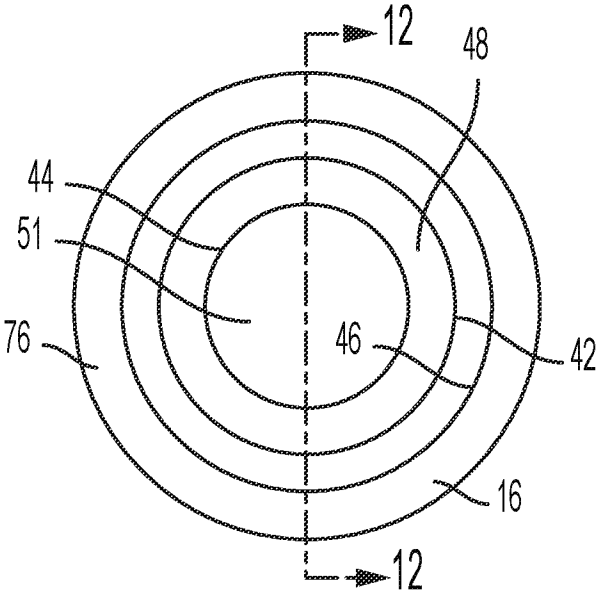
FIG. 11 is a top view of the washer of FIG. 9.

With reference to FIGS. 6-8, in one aspect or embodiment, the tool portion 14 is a carbide tip which helps to cut the application surface as a result of rotation into the application surface. The tool portion 14 has a tip 40, which helps to create some of the cutting force that works an application surface. Although the tool portion 14 is a carbide tip, it is contemplated that other tools known to those having skill in the art may be used.

With reference to FIGS. 1, 2, and 9-12, the washer 16 receives the intermediate portion 22 of the shank 12 and, in particular, receives the engaging portion 32 and shoulder 34 within the washer 16. The washer 16 shares the axis A with the shank 12 and the tool portion 14. The washer 16 includes a first end 42 and a second end 44 positioned opposite the first end 42. An opening 51 extends between the first end 42 and the second end 44, and the opening 51 is configured to receive the engaging portion 32 and the shoulder 34 within the opening 51. The washer includes a first step 46 and a second step 48 that engage different portions of the shank 12 when the engaging portion 32 and the shoulder 34 are received within the opening 51. The steps 46, 48 more specifically define the shape of the opening 51. In particular, the steps 46, 48 define a first passage 50 and a second passage 52 within the opening 51. Both passages 50, 52 receive the shank 12; however, the steps 46, 48 correspond to the shape of the shoulder 34 and the engaging portion 32 so that the intermediate portion 22 of the shank 12 conforms to the passages 50, 52 of the opening 51. A transition between the first step 46 of the washer 16 and the first passage 50 includes a first radiused portion 70. A transition between the second step 48 of the washer 16 and the second passage 52 includes a second radiused portion 72. A transition between the first passage 50 and the second step 48 of the washer 16 includes a third radiused portion 74. The first radiused portion 70 is smaller than the second radiused portion 72.

With reference to FIG. 2, a side of the first step 46 is adjacent to and abuts a side of the engaging portion 32, and the shoulder 34 sits on and abuts the second step 48. This allows the engaging portion 32 to fit within the first passage 50 of the opening 51. The first step 46 also abuts the bottom surface 28 of the head 24 to fit the washer 16 around the intermediate portion 22 and against the head 24 of the shank 12. The intermediate portion 22 may extend through the second passage 52 of the opening 51, or a portion of the shaft 20 may extend through the second passage 52 and out the second end 44. The two steps 46, 48 make it difficult for fines to get between the washer 16 and the shank 12 as well as between the shank 12 and the retaining sleeve 18, which will be described below. The washer 16 may include a frustoconical surface 76 positioned radially outward from the first step 46. For example, the body of the washer 16 may be chamfered near the first step 46 to define the frustoconical surface 76, which extends at approximately 60 degrees relative to a plane extending perpendicularly to the axis A. The second end 44 of the washer 16 includes a centering portion 78 having a frustoconical outer surface 80. The first step 46 and the second step 48 are each planar. The frustoconical surface 76 widens as the surface 76 extends from the first end 42 toward the second end 44 of the washer 16. The frustoconical outer surface 80 of the centering portion 78 widens as the surface 80 extends from the second end 44 toward the first end 42 of the washer 16.

Figure 14:
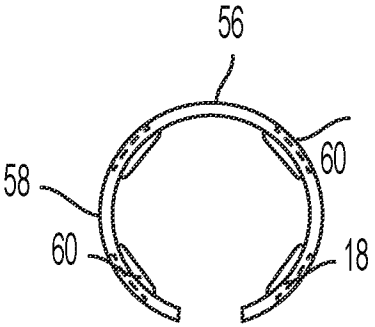
FIG. 14 is a bottom view of the retainer of FIG. 13.
Figure 13:
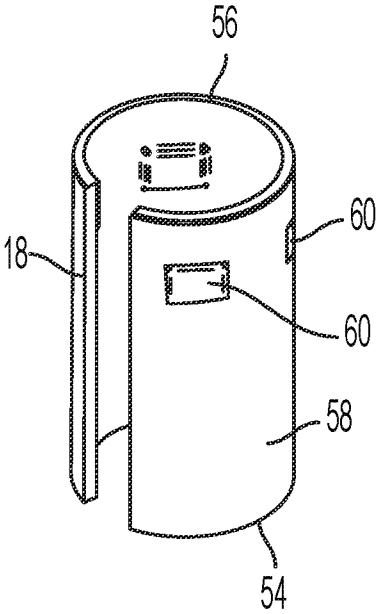
FIG. 13 is a perspective view of a retainer of the tool bit assembly of FIG. 1.
Figure 16:
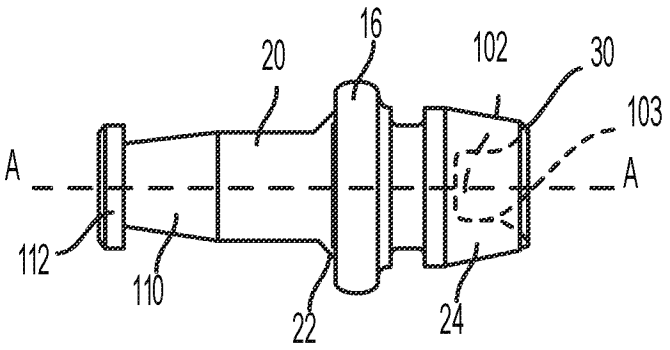
FIG. 16 is a side view of a shank of the tool bit assembly of FIG. 15, showing internal features via hidden lines.

With reference to FIGS. 13 and 14, the retaining sleeve 18 includes a first end 54 and a second end 56. Between these ends 54, 56, a body extends and defines a hollow shaft, the size of which corresponds to the diameter of the shaft 20 of the shank 12. Like the shank 12, tool portion 14, and washer 16, the retaining sleeve 18 shares axis A. Proximate the second end 56, indentations 60 extend about the retaining sleeve 18. The indentations 60 fit about the shaft 20, and the shaft 20 may include a corresponding recess in order to allow the indentations 60 to slide within the recess, so that the retaining sleeve 18 and shank 12 can rotate when the assembly 10 is used. The first end 54 of the retaining sleeve 18 may abut the second end 56.

Each element may rotate about the axis A during use of the tool bit and washer assembly 10. This rotation helps to decrease wear on the assembly 10 during use and prolongs the life of each element in the assembly 10 and the greater tooling system. The washer 16 helps to prevent fines from entering the assembly 10 and also prolongs the life of each element described herein and other elements or tools that may be used with this assembly 10 by one of ordinary skill in the art.

Referring to FIGS. 15-18, a tool bit assembly 100 according to another non-limiting embodiment or aspect is shown. In this second embodiment, the shank 12 of the tool bit assembly 100 includes a cavity 102 for securing the tool 14 to the shank 12. The cavity 102 is defined within the head 24 of the shank 12 and extends from the top surface 30 in the direction of the bottom surface 28. The tool 14 includes an extension 104 that corresponds to and is received by the cavity 102. The shapes of the cavity 102 and the extension 104 correspond so that the tool 14 can securely attach to the shank 12, and the tip 40 can act on the work surface. When attached, the extension 104 and tool 14 may be brazed to the cavity 102 and head 24.

As shown, the extension 104 is generally tapered in the direction of the bottom surface 28 of the head 24 of the shank 12 with the cavity 102 taking the opposite shape of the tapered extension 104. A sidewall 103 of the cavity 102 may be angled at different degrees relative to the central axis A. For example, a first portion of the sidewall 103 may be angled at 30-40 degrees relative to the central axis A, and a second portion of the sidewall 103 may be angled at 1-10 degrees relative to the central axis A. It is contemplated that the cavity 102 and extension 104 may take other corresponding shapes that facilitate the connection between the tool 14 and the shank 12. To assist in this connection, a nipple 106 may extend from within the cavity 102 in the direction of the first surface 30 and be received within a hole 108 located on a bottom surface of the extension 104. The hole 108 and nipple 106 may also be brazed together when connecting the tool 14 to the shank.

Figure 15:
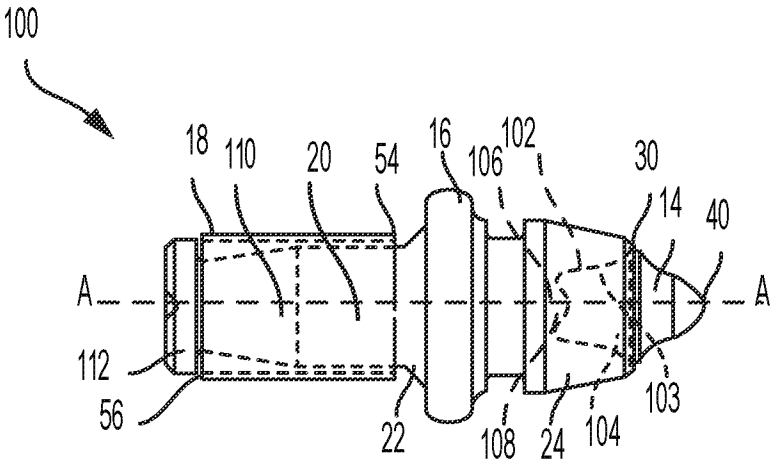
FIG. 15 is a side view of a tool bit assembly, showing internal features via hidden lines and according to another embodiment or aspect of the present disclosure.
Figure 18:
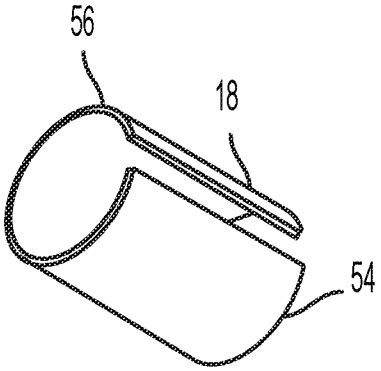
FIG. 18 is a perspective view of a retainer of the tool bit assembly of FIG. 15.
Figure 17:
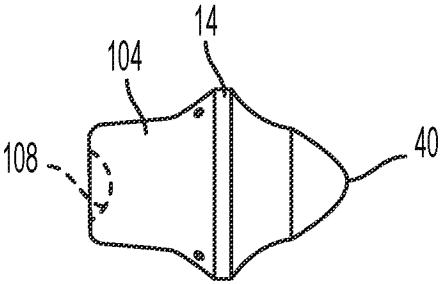
FIG. 17 is a side view of a carbide tip of the tool bit assembly of FIG. 15.

The shaft 20 of the shank 12 also includes a tapered section 110 that extends in a direction opposite that of the head 24 of the shank 12. The taper may begin at a location proximate the midpoint of the shaft 20 and be formed at 5-15 degrees relative to the central axis A. The tapered section 110 terminates at a step 112 that extends radially outward from the central axis A. In the radial direction, the step 110 extends a distance greater than or equal to that of the widest portion of the tapered section 110. When the tool bit assembly 100 is completely assembled, the step 112 holds the retaining sleeve 18 in place about the shaft 20. As shown in FIGS. 15 and 18, the shaft 20 is smooth without the indentations 60 described above. The second end 56 of the retaining sleeve 18 is adjacent to and may abut an end of the step 112 when in use. This alignment between the second end 56 of the retaining sleeve 18 and the step 112 serves to keep the retaining sleeve 18 about the shank 12 and central axis A.

In this embodiment each of the shank 12, tool 14, heavy duty washer 16, and retaining sleeve 18 continue to share the central axis A and rotate about the central axis A during use of the tool bit assembly 100. The washer 16 also interacts with the shank 12 in the same or a similar manner as described above.

While specific embodiments of the device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the device of the present disclosure, which is to be given the full breadth of the claims appended and any and all equivalents thereof.

The invention claimed is:

1. A tool bit assembly comprising:

a shank comprising an elongated shaft, an intermediate portion extending from the elongated shaft, a head extending from the intermediate portion, and a tool portion extending from the head;

a retainer comprising a first end and a second end with a body defining a hollow shaft therebetween, the hollow shaft configured to receive at least a portion of the elongated shaft of the shank therethrough; and a washer having a first end and a second end, the washer defining an opening extending from the first end to the second end of the washer, the washer comprising at least a first step and a second step, the opening of the washer configured to receive at least a portion of the intermediate portion of the shank therethrough, wherein the first step is configured to abut a bottom surface of the head of the shank, and the second step is configured to abut a first shoulder of the intermediate portion of the shank.

2. The tool bit assembly of claim 1, wherein the tool portion of the shank comprises a carbide tip.

3. The tool bit assembly of claim 1, wherein the opening of the washer defines a first passage extending from the first end to the second step and a second passage extending from the second step to the second end, and wherein the first passage and the second passage are configured to receive at least a portion of the intermediate portion therein, and wherein the second end abuts the first end of the retainer.

4. The tool bit assembly of claim 3, wherein a top surface of the head of the shank has a first diameter and the bottom surface of the head of the shank has a second diameter larger than the first diameter.

5. The tool bit assembly of claim 4, wherein the intermediate portion comprises a first engagement surface comprising the first shoulder, the first engagement surface having a third diameter smaller than the second diameter.

6. The tool bit assembly of claim 5, wherein the first passage receives at least a portion of the first engagement surface therein.

7. The tool bit assembly of claim 3, wherein a transition between the first step of the washer and the first passage comprises a first radiused portion.

8. The tool bit assembly of claim 7, wherein a transition between the second step of the washer and the second passage comprises a second radiused portion.

9. The tool bit assembly of claim 8, wherein a transition between the first passage and the second step of the washer comprises a third radiused portion.

10. The tool bit assembly of claim 8, wherein the first radiused portion is smaller than the second radiused portion.

11. The tool bit assembly of claim 1, wherein the retainer further comprises a plurality of indentations proximate the second end.

12. The tool bit assembly of claim 1, wherein the retainer further comprises a gap along an entire length of the retainer.

13. The tool bit assembly of claim 12, wherein the top surface of the head of the shank comprises a nipple extending in an axial direction, and wherein the nipple is configured to engage with the tool portion.

14. The tool bit assembly of claim 13, wherein the tool portion comprises a receiving slot configured to receive the nipple therein.

15. The tool bit assembly of claim 1, wherein a top surface of the washer comprises a frustoconical surface positioned radially outward from the first step.

16. The tool bit assembly of claim 1, wherein the second end of the washer further comprises a centering portion having a frustoconical outer surface.

17. The tool bit assembly of claim 1, wherein the first step and the second step of the washer are each planar.

* * * * *